US007191778B2

(12) United States Patent
Shue et al.

(10) Patent No.: US 7,191,778 B2
(45) Date of Patent: Mar. 20, 2007

(54) RESPIRATORY MASK WITH AN AIR-IMPERMEABLE SHIELD

(76) Inventors: Ming-Jeng Shue, No. 14, Lane 8, Chung-I St., Hsi Dist., Taichung City (TW); Deborah Huang, 7F, No. 5, Sec. 3, Liu-Chun E. St., Chung Dist., Taichung City (TW)

( * ) Notice: Subject to any disclaimer, the term of this patent is extended or adjusted under 35 U.S.C. 154(b) by 73 days.

(21) Appl. No.: 10/761,527
(22) Filed: Jan. 20, 2004

(65) Prior Publication Data

US 2004/0221849 A1 Nov. 11, 2004

(30) Foreign Application Priority Data

May 9, 2003 (TW) ..... 92112695 A

(51) Int. Cl.
*A62B 18/00* (2006.01)
*A62B 18/08* (2006.01)

(52) U.S. Cl. ..... 128/200.27; 128/206.17; 128/205.27

(58) Field of Classification Search ..... 128/200.27, 128/201.17, 201.23, 203.29, 205.25, 206.12, 128/206.16, 206.17, 206.19, 206.21, 206.24, 128/206.28

See application file for complete search history.

(56) References Cited

U.S. PATENT DOCUMENTS 4,501,272 A * 2/1985 Shigematsu et al. ... 128/206.15
4,630,604 A * 12/1986 Montesi ..... 128/206.15
6,817,362 B2 * 11/2004 Gelinas et al. ..... 128/206.17

* cited by examiner

*Primary Examiner*—Justine R. Yu
*Assistant Examiner*—Shumaya Ali
(74) *Attorney, Agent, or Firm*—Ostrolenk, Faber, Gerb & Soffen, LLP

(57) ABSTRACT

A respiratory mask includes a shield and a mask body. The shield includes an air-impermeable bent sheet that defines a rim-receiving recess. The mask body is detachably connected to the shield and includes a rim that is received in the rim-receiving recess and that defines a chamber therein. The shield cooperates with the mask body to define a gap therebetween. The rim is formed with at least an aperture that is in spatial communication with the chamber and the gap. A filter sheet is permeable to air and is attached to the rim to cover the aperture.

6 Claims, 11 Drawing Sheets

RESPIRATORY MASK WITH AN AIR-IMPERMEABLE SHIELD

BACKGROUND OF THE INVENTION

1. Field of the Invention

This invention relates to a respiratory mask with a filter sheet and an air-impermeable shield disposed frontwardly and connected to the filter sheet.

2. Description of the Related Art

Conventional respiratory masks normally include a filter sheet that is permeable to air and that is exposed to the atmosphere so as to permit air flow therethrough upon breathing. However, the conventional respiratory masks are disadvantageous in that they cannot provide effective protection for the wearer from transmission of virus carried by infectious droplets that attach thereto. When the respiratory mask worn on a wearer is accidentally contaminated with virus-containing droplets, the droplets will gradually evaporate and there is a tendency for the virus carried by the droplets to be sucked by the wearer through the mask during breathing.

SUMMARY OF THE INVENTION

Therefore, the object of the present invention is to provide a respiratory mask with an air-impermeable shield that is capable of overcoming the aforesaid drawback of the prior art.

According to one aspect of the present invention, there is provided a respiratory mask that comprises: a shield including a bent sheet that is made from a material impermeable to air, that defines a rim-receiving recess at a concave side of the bent sheet, and that has a central portion which is adapted to confront the nose and the mouth of a wearer; and a mask body detachably connected to the shield and including a rim that is received in the rim-receiving recess, that defines a chamber therein for receiving the nose and the mouth of the wearer, and that has an outer end in contact with the central portion of the bent sheet, and an inner end opposite to the outer end and adapted to contact the face of the wearer. The rim is formed with at least an aperture that is disposed between the inner and outer ends and that is in spatial communication with the chamber. The mask body further includes a filter sheet that is permeable to air and that is attached to the rim to cover the aperture. The filter sheet cooperates with the bent sheet to define a gap therebetween. The gap is in fluid communication with the chamber through the filter sheet and the aperture.

According to another aspect of this invention, there is provided a respiratory mask that comprises: a shield including a bent sheet that is made from a material impermeable to air, and that defines a receiving recess at a concave side of the bent sheet, the receiving recess having a size that is sufficient to cover the nose and the mouth of a wearer, the bent sheet having two opposite sides, each of which is formed with a pair of upper and lower strap holes; and a mask body detachably connected to the shield, received in the receiving recess, and including a filter sheet that is permeable to air, and a pair of opposite straps that are respectively secured to two opposite sides of the filter sheet. Each of the straps has two opposite ends that respectively extend through the upper and lower strap holes. The upper and lower strap holes are spaced apart from each other by a distance that is greater than the length of the respective one of the opposite sides of the filter sheet.

BRIEF DESCRIPTION OF THE DRAWINGS

In drawings which illustrate embodiments of the invention.

DETAILED DESCRIPTION OF THE PREFERRED EMBODIMENTS

Figure 1:
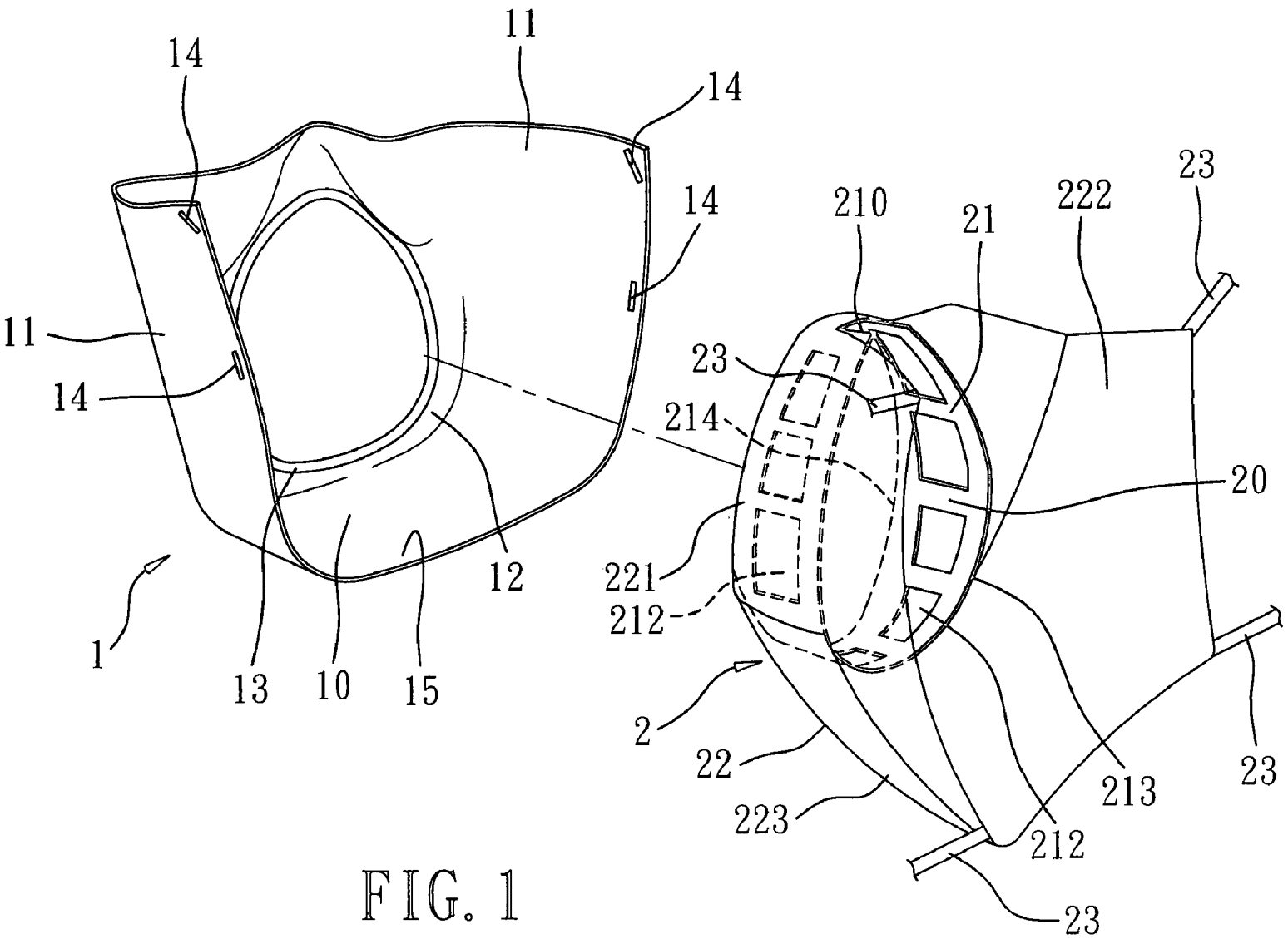
FIG. 1 is an exploded rear perspective view of the first preferred embodiment of a respiratory mask according to the present invention.
Figure 2:
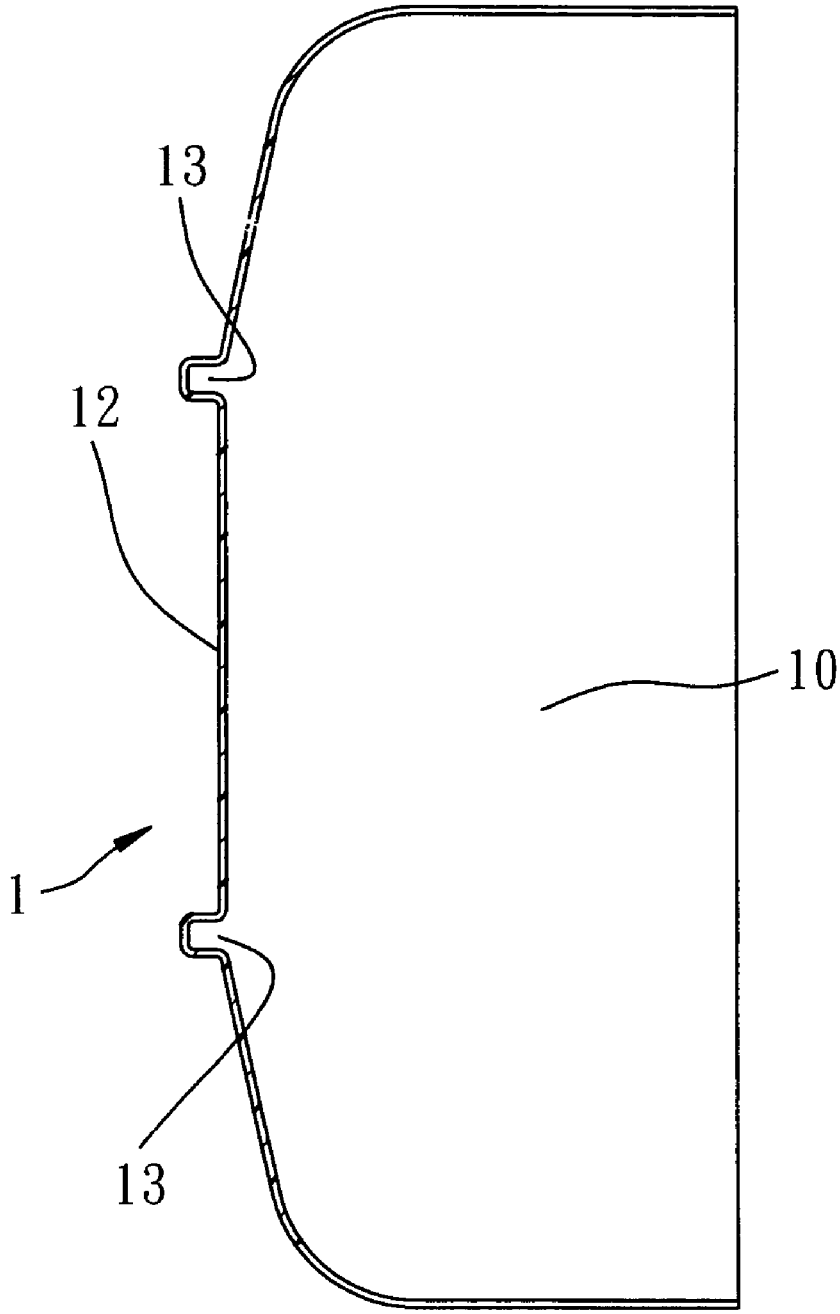
FIG. 2 is a sectional view of a shield of the respiratory mask of FIG. 1.
Figure 3:
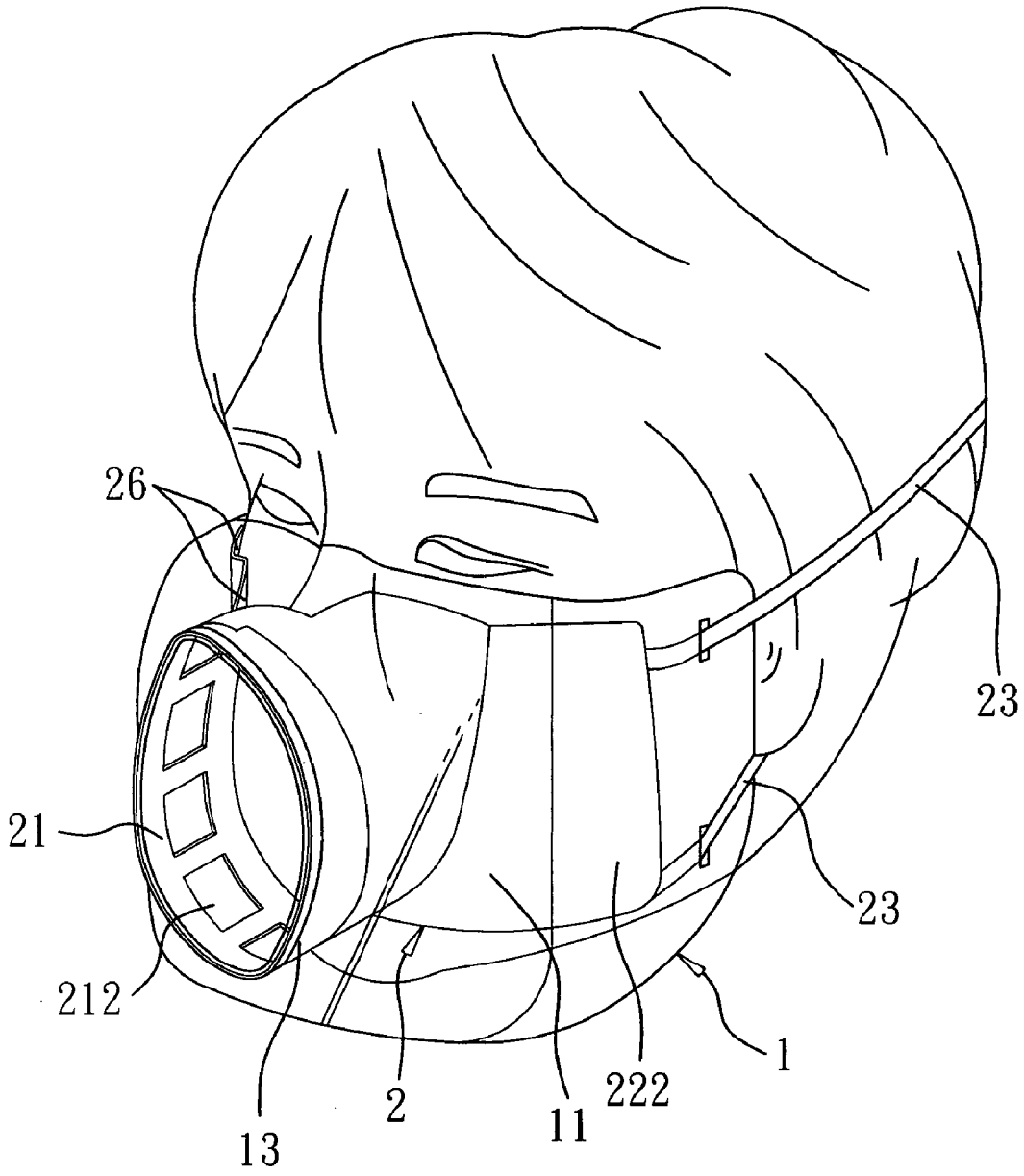
FIG. 3 is a front perspective view to illustrate the respiratory mask of FIG. 1 in a state of use.
Figure 4:
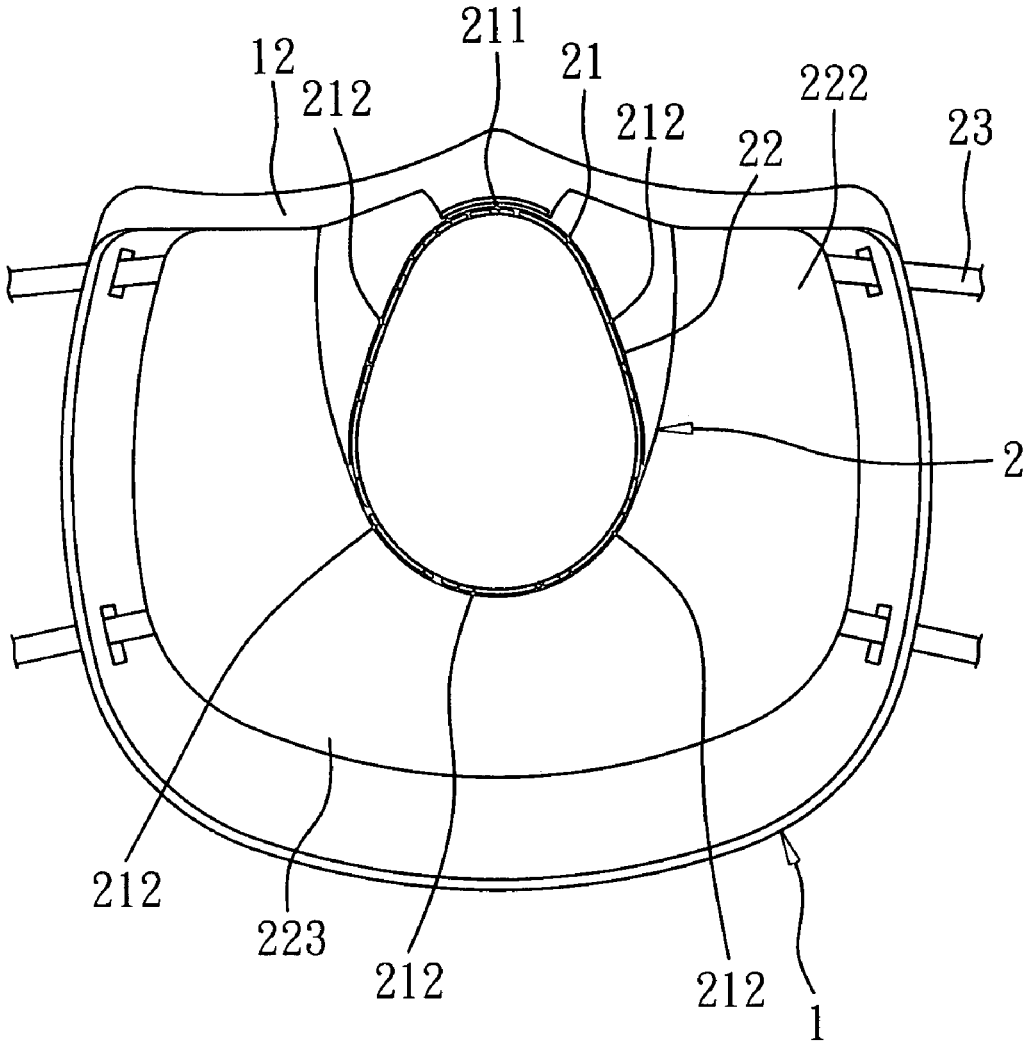
FIG. 4 is a rear view of the respiratory mask of FIG. 1.

For the sake of brevity, like elements are denoted by the same reference numerals throughout the disclosure.

FIGS. 1 to 4 illustrate the first preferred embodiment of a respiratory mask according to the present invention. The respiratory mask includes: a shield having a bent sheet 1 (note that the bent sheet 1 is transparent) that is made from a material (such as plastics) impermeable to air, that defines a rim-receiving recess 10 at a concave side of the bent sheet 1, and that has a central portion 12 which is adapted to confront the nose and the mouth of a wearer; and a mask body 2 detachably connected to the shield and including a rim 21 that is received in the rim-receiving recess 10, that defines a chamber 20 therein for receiving the nose and the mouth of the wearer, and that has an outer end 214 in contact with the central portion 12 of the bent sheet 1, and an inner end 213 opposite to the outer end 214 and adapted to contact the face of the wearer. The rim 21 has an outer surface 210 that extends between the inner and outer ends 213, 214, and is formed with a plurality of apertures 212 that are in spatial communication with the chamber 20. The mask body 2 further includes a filter sheet 22 that is permeable to air and that is attached to the rim 21 to cover the apertures 212. The filter sheet 22 cooperates with the bent sheet 1 to define a gap 26 therebetween (see FIG. 3). The gap 26 is in fluid communication with the chamber 20 through the filter sheet 22 and the apertures 212, and has a volume that is small so as to minimize the amount of the exhaled air trapped in the gap 26.

Preferably, the central portion 12 of the bent sheet 1 is formed with an endless groove 13 that protrudes outwardly of the rim-receiving recess 10 and that receives the outer end 214 of the rim 21 therein so as to permit the bent sheet 1 to be firmly held on the mask body 2.

The filter sheet 22 has a rim portion 221 that surrounds and that covers the outer surface 210 of the rim 21, a pair of opposite side portions 222 that extend outwardly from the rim portion 221 for contacting the cheeks of the wearer, and a lower portion 223 for contacting the chin of the wearer.

The bent sheet 1 further has a pair of opposite cheek portions 11 that extend transversely and respectively from two opposite sides of the central portion 12 and that respectively confront the side portions 222 of the filter sheet 2, and a chin portion 15 that extends transversely from a bottom side of the central portion 12, that interconnects the cheek portions 11, and that confronts the lower portion 223 of the filter sheet 22. The cheek and chin portions 11, 15 of the bent sheet 1 cooperate with the side and lower portions 222, 223 of the filter sheet 22 to define the gap 26 thereamong.

Each of the cheek portions 11 of the bent sheet 1 is formed with at least a pair of strap holes 14. The respiratory mask further includes two pairs of straps 23 that are respectively secured to the side portions 222 of the filter sheet 22 and that respectively extend through the strap holes 14 in the cheek portions 11 of the bent sheet 1.

The rim 21 has a top end portion 211 (see FIG. 4) with a shape that conforms to the contour of the bridge and two sides of the nose of the wearer.

Figure 5:
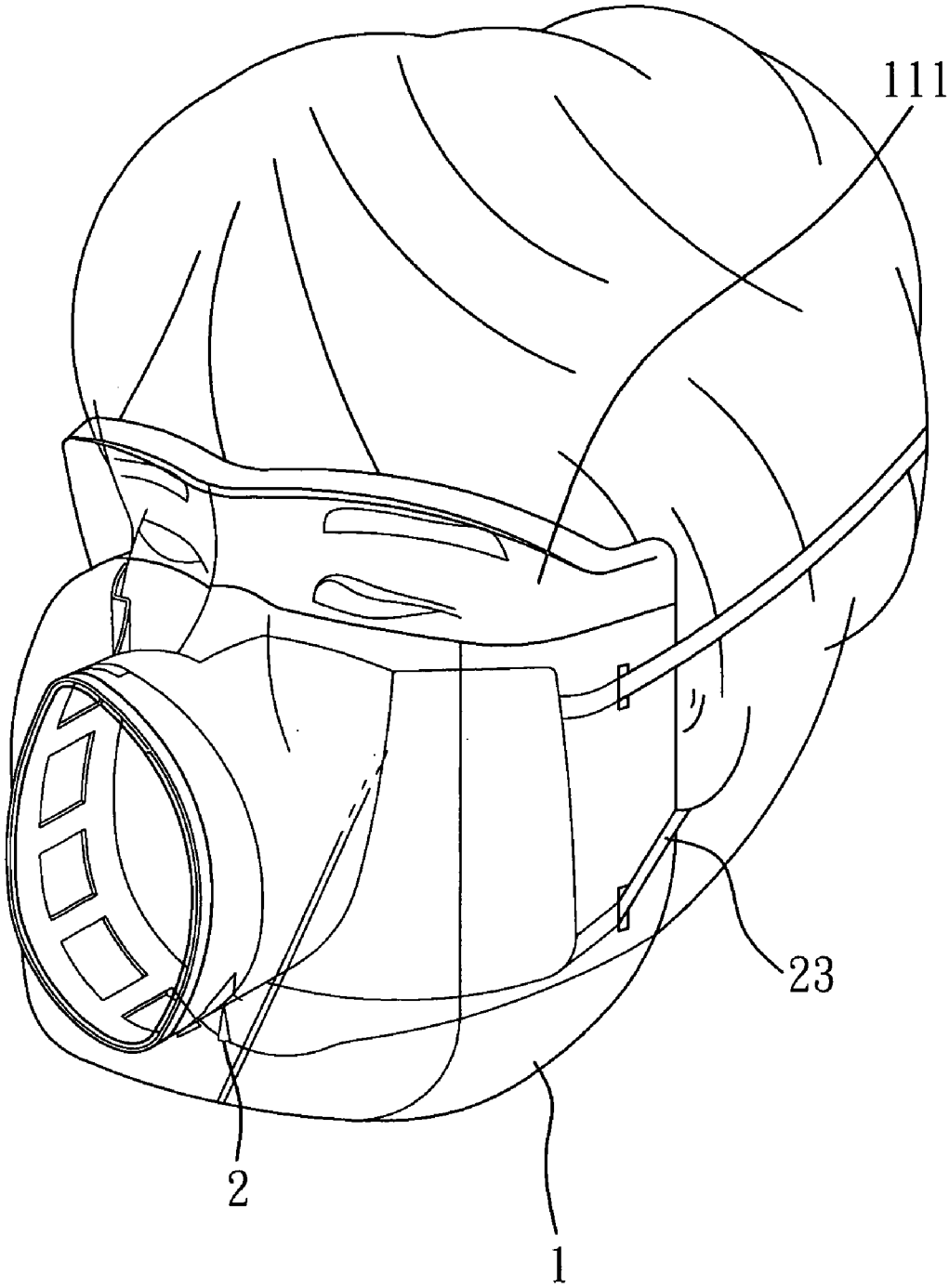
FIG. 5 is a perspective view of the second preferred embodiment of the respiratory mask according to the present invention.

FIG. 5 illustrates the second preferred embodiment of the respiratory mask of this invention, which is similar to the previous embodiment, except that the bent sheet 1 is further formed with an eye-protecting portion 111 extending upwardly from a top side of the bent sheet 1 so as to cover the eyes of the wearer when the respiratory mask is in use.

Figure 6:
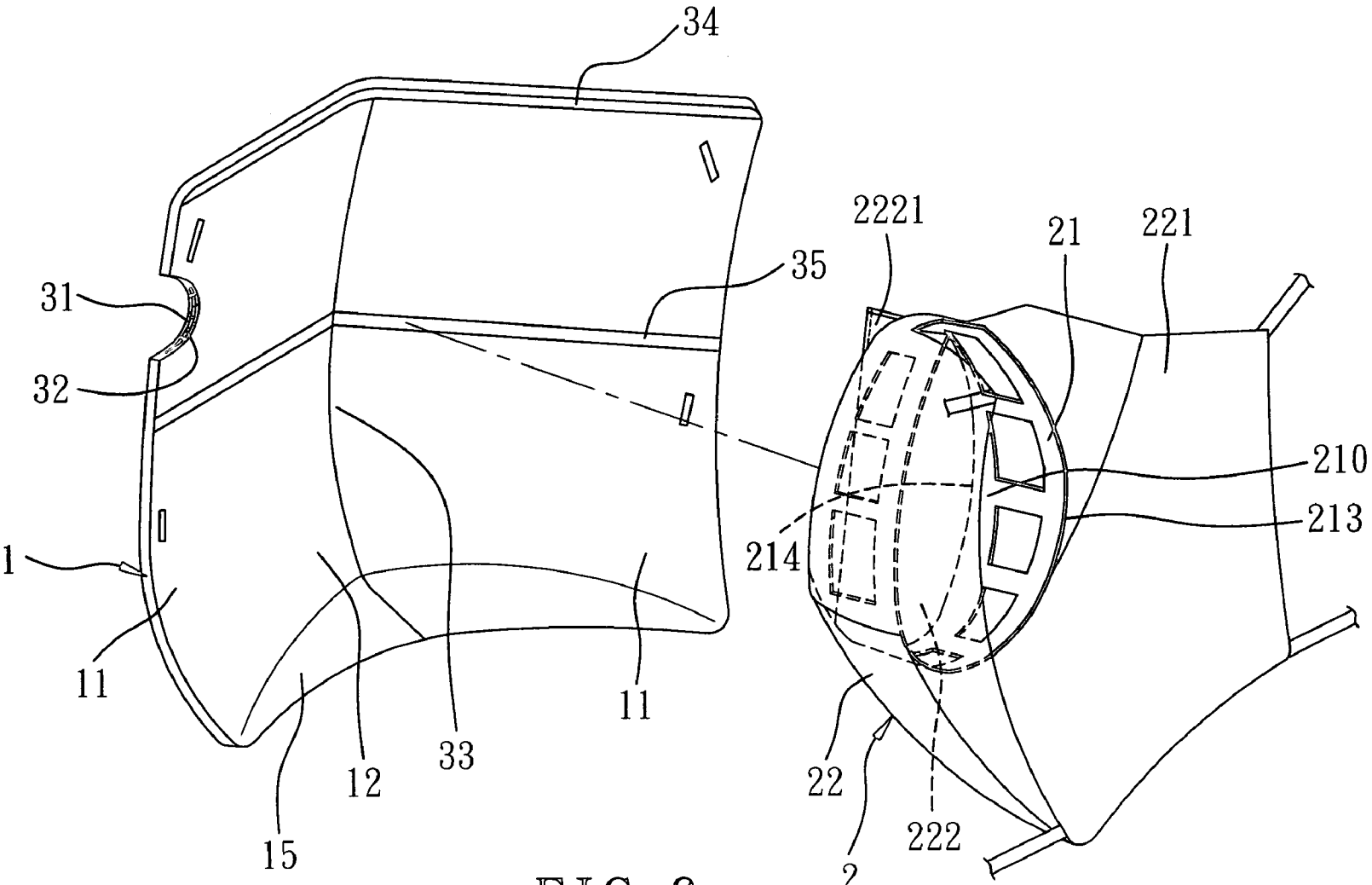
FIG. 6 is an exploded rear perspective view of the third preferred embodiment of the respiratory mask according to the present invention.
Figure 7:
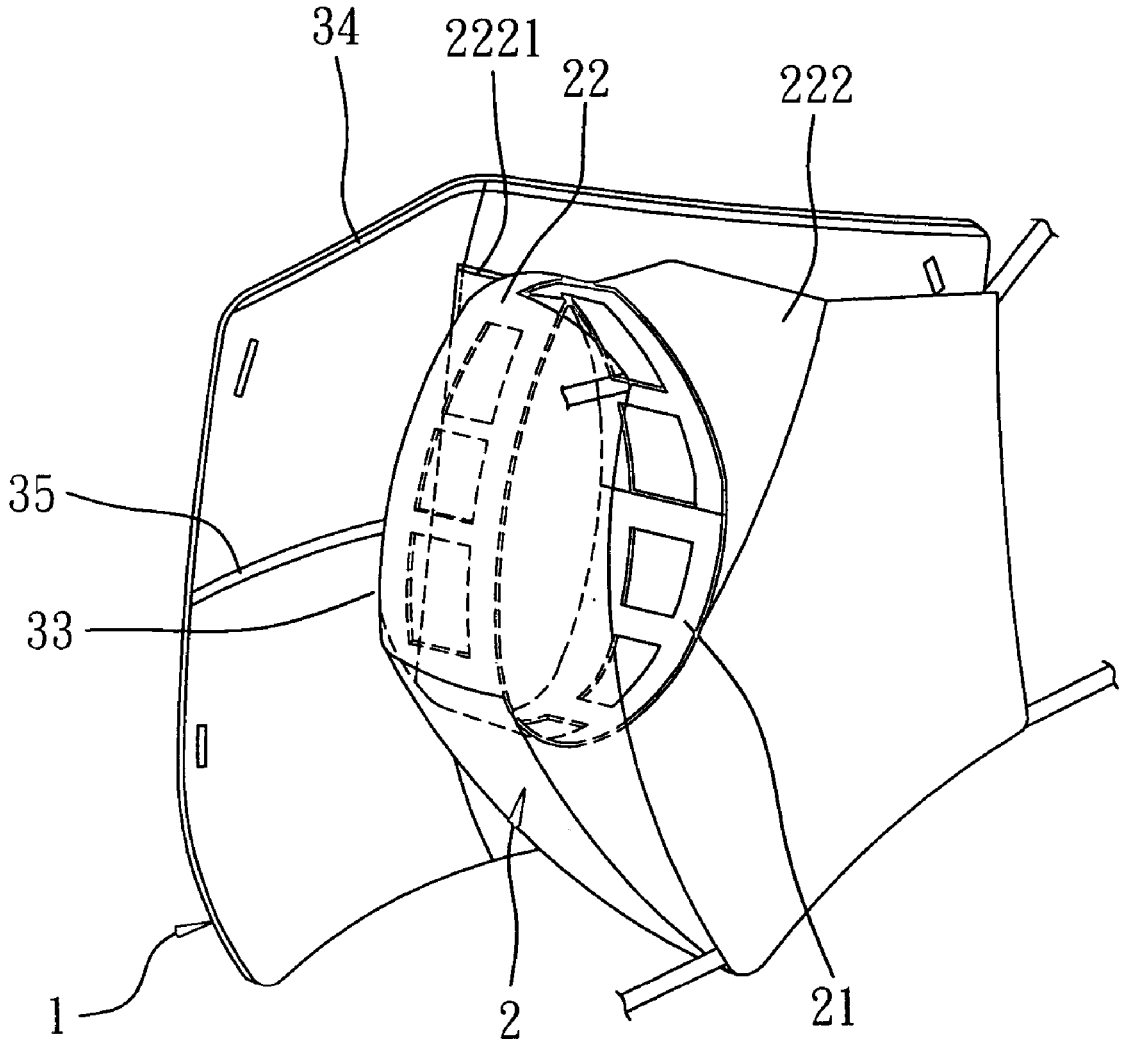
FIG. 7 is a rear perspective view of the third preferred embodiment to illustrate how a shield is connected to a mask body.
Figure 8:
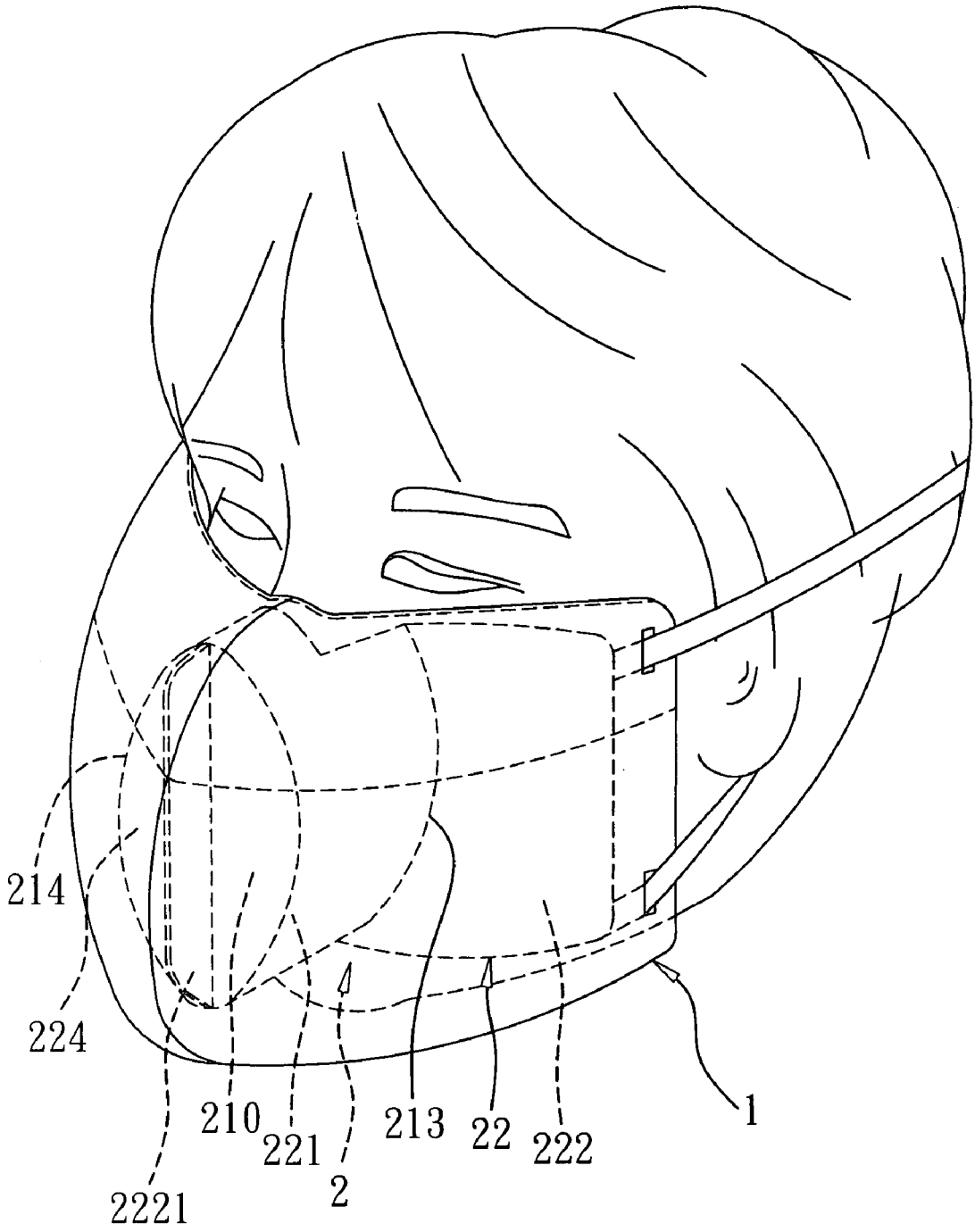
FIG. 8 is a front perspective view to illustrate the respiratory mask of FIG. 6 in a state of use.

FIGS. 6 to 8 illustrate the third preferred embodiment of the respiratory mask of this invention, which differs from the first embodiment in the structure of the shield. The bent sheet 1 of the shield of this embodiment is V-shaped instead of U-shaped. The shield further includes a flexible top rib 34 that is secured to the top side of the bent sheet 1 and that crosses the central and cheek portions 12, 11 of the bent sheet 1, and a flexible lower rib 35 that is secured to the bent sheet 1 below the top rib 34 and that crosses the central and cheek portions 12, 11 of the bent sheet 1. The central portion 12 of the bent sheet 1 is formed with a V-shaped groove 33 that extends from the bottom side to the top side of the bent sheet 1 in a transverse direction relative to the top and lower ribs 34, 35. The filter sheet 2 further has a central portion 224 that extends inwardly of the rim 21 from the rim portion 221 of the filter sheet 22 and that covers the outer surface 210 at the outer end 214 of the rim 21, and a protrusion 2221 that protrudes outwardly from the central portion 224 of the filter sheet 22 into the V-shaped groove 33. The bent sheet 1 is formed of a plurality of non-woven fabric layers 31 (see the cutaway region in *Fig.* 6) and an air-impermeable plastic layer 32 embedded in the non-woven fabric layers 31. The top and lower ribs 34, 35 permit shaping of the bent sheet 1 to conform to the contour of the face of the wearer.

Figure 9:
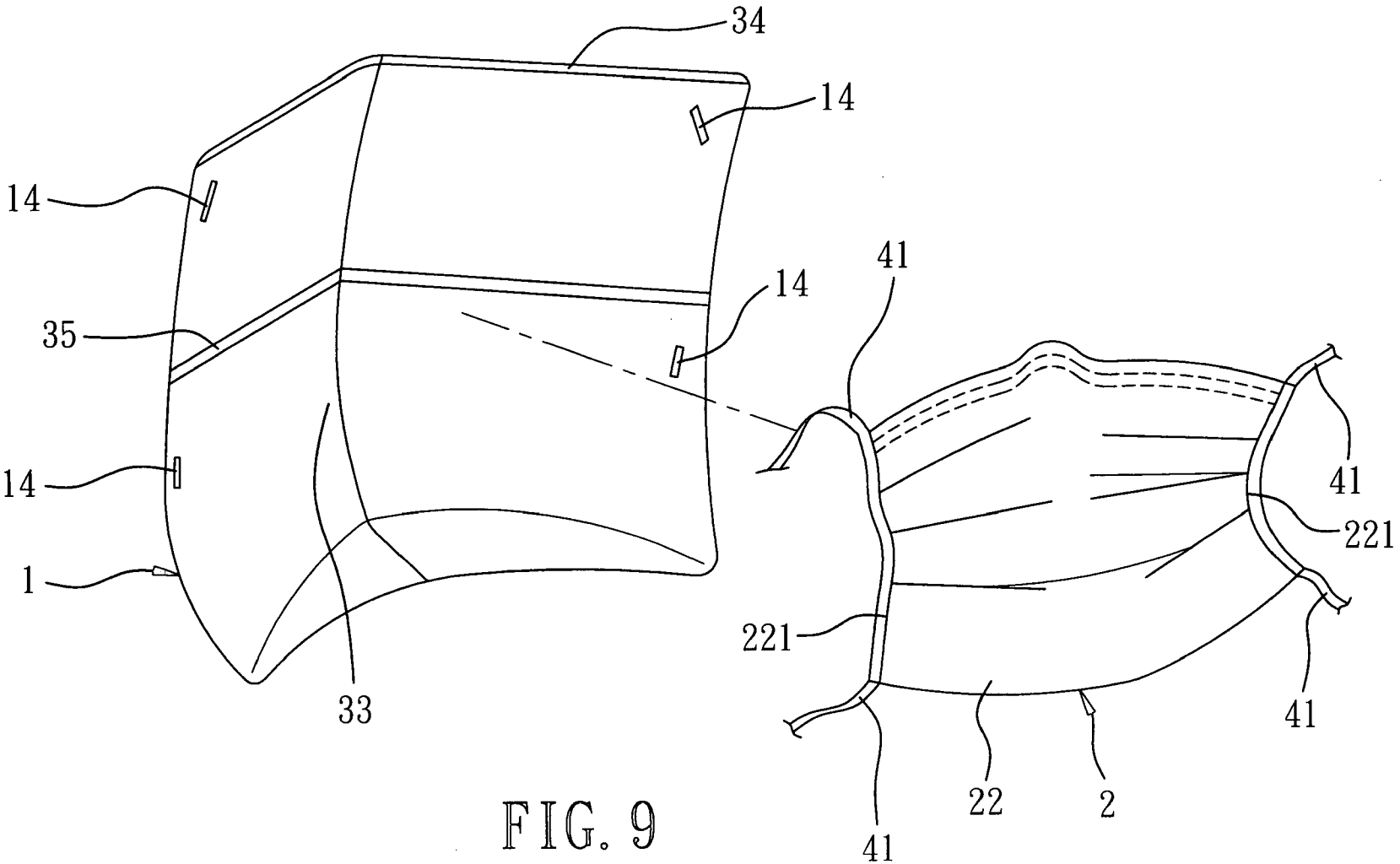
FIG. 9 is an exploded rear perspective view of the fourth preferred embodiment of the respiratory mask according to the present invention.
Figure 10:
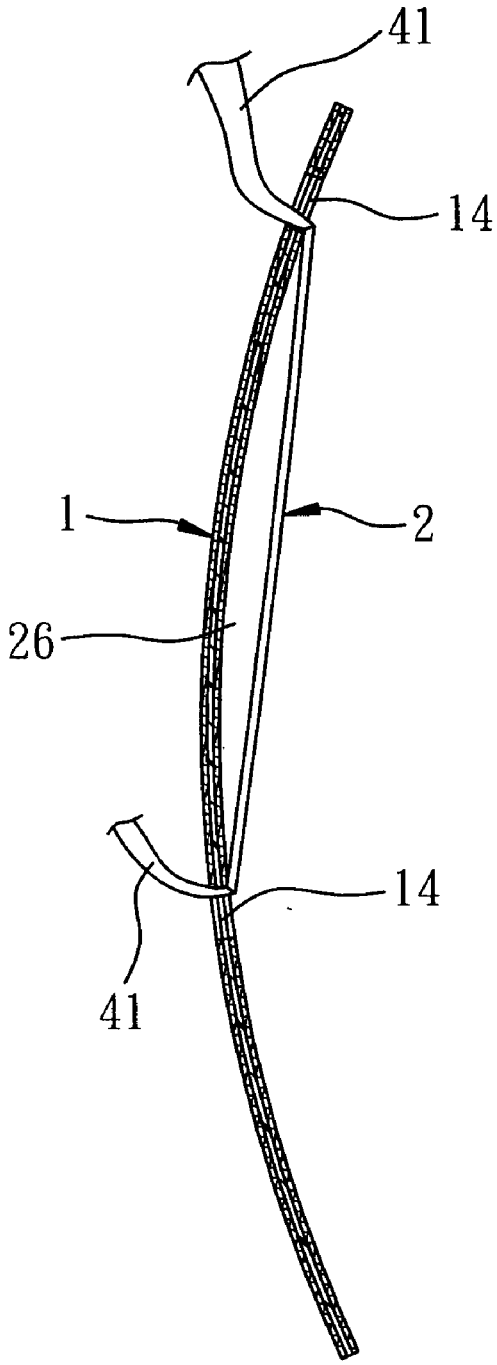
FIG. 10 is a side sectional view of the fourth preferred embodiment.
Figure 11:
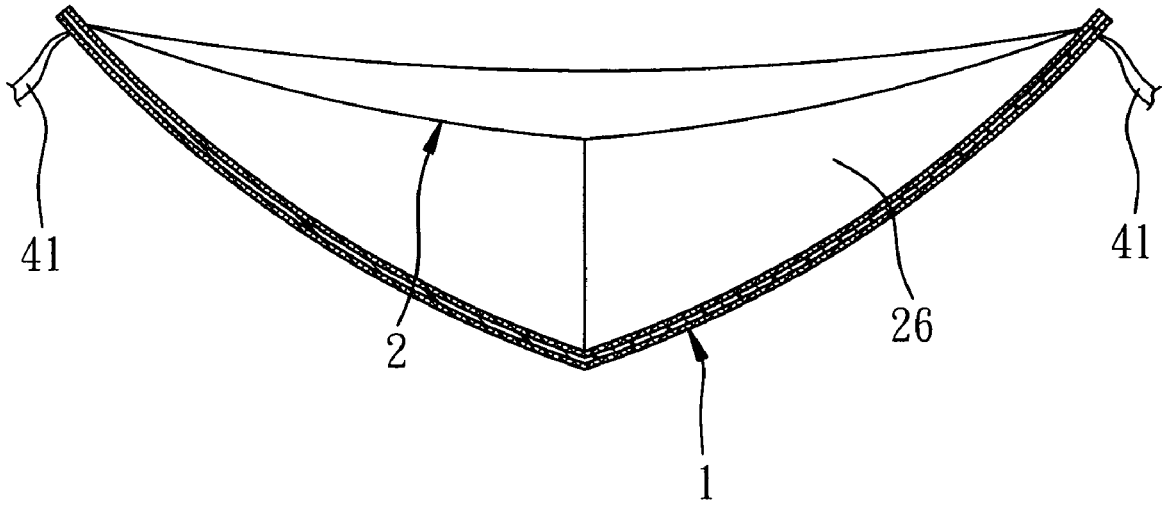
FIG. 11 is a top sectional view of the fourth preferred embodiment.

FIGS. 9 to 11 illustrate the fourth preferred embodiment of the respiratory mask of this invention, which is similar to the third embodiment, except that the mask body 2 is a general surgical mask. The bent sheet 1 has two opposite sides, each of which is formed with a pair of upper and lower strap holes 14. The mask body 2 is detachably connected to the bent sheet 1 of the shield, is received in the receiving recess 33, and includes a filter sheet 22 that is permeable to air, and a pair of opposite straps 41 that are respectively secured to two opposite sides 221 of the filter sheet 22. Each strap 41 has two opposite ends that respectively extend through the upper and lower strap holes 14. The upper and lower strap holes 14 are spaced apart from each other by a distance greater than the length of the respective one of the opposite sides 221 of the filter sheet 22 so as to raise the bent sheet 1 and so as to permit the formation of the gap 26 between the bent sheet 1 and the filter sheet 22. With the inclusion of the shield in the respiratory mask of this invention, the drawback as encountered in the prior art can be eliminated.

With the invention thus explained, it is apparent that various modifications and variations can be made without departing from the spirit of the present invention.

We claim:

1. A respiratory mask comprising:

a shield of an air impermeable bent sheet that defines a rim-receiving recess at a concave side of said bent sheet, and that has a central portion which is adapted to confront the nose and the mouth of a wearer; and a mask body aligned with the bent sheet in a transverse direction relative to the face of the wearer, detachably connected to said shield, said mask body including a rim that is received in said rim-receiving recess, that defines a chamber therein for receiving the nose and the mouth of the wearer, wherein said rim includes:

an outer end covered by said central portion of said sheet, and an inner end opposite to said outer end in the transverse direction configured and positioned to contact the face of the wearer, said rim being formed with an aperture that is disposed between and that is spaced apart from said inner and outer ends and that is in spatial communication with said chamber, said mask body further including a filter sheet that is permeable to air, that is attached to said rim to cover said aperture, that extends outwardly from an exterior of said rim, and that is covered by said bent sheet, said filter sheet cooperating with said bent sheet to define a gap therebetween, said gap extending outwardly of said chamber from the exterior of said rim and being in fluid communication with said chamber through said filter sheet and said aperture.

2. The respiratory mask of claim 1, wherein said central portion of said bent sheet is formed with an endless groove that protrudes outwardly of said rim-receiving recess and that receives said outer end of said rim therein.

3. The respiratory mask of claim 1, wherein said rim further has an outer surface extending between said inner and outer ends of said rim, said filter sheet having a rim portion that surrounds and that covers said outer surface of said rim, a pair of opposite side portions that extend outwardly from said rim portion for contacting the cheeks of the wearer, and a lower portion for contacting the chin of the wearer.

4. The respiratory mask of claim 3, wherein said bent sheet has top and bottom sides, said bent sheet further having a pair of opposite cheek portions that extend transversely and respectively from two opposite sides of said central portion and that respectively confront said side portions of said filter sheet, and a chin portion that extends transversely from said bottom side of said central portion, that interconnects said cheek portions, and that confronts said lower portion of said filter sheet, said cheek and chin portions of said bent sheet cooperating with said side and lower portions of said filter sheet to define said gap thereamong.

5. The respiratory mask of claim 4, wherein each of said cheek portions of said bent sheet is formed with at least a strap hole, said respiratory mask further comprising at least a pair of straps that are respectively secured to said side portions of said filter sheet and that respectively extend through said strap holes in said cheek portions of said bent sheet.

6. The respiratory mask of claim 5, wherein said shield further includes a flexible top rib that is secured to said top side of said bent sheet and that crosses said central and cheek portions of said bent sheet, and a flexible lower rib that is secured to said bent sheet below said top rib and that crosses said central and cheek portions of said bent sheet, said central portion of said bent sheet being formed with a V-shaped groove that extends from said bottom side to said top side of said bent sheet in a transverse direction relative to said top and lower ribs, said filter sheet further having a central portion that extends inwardly of said rim from said rim portion of said filter sheet and that covers said chamber at said outer end of said rim, and a protrusion that protrudes outwardly from said central portion of said filter sheet into said V-shaped groove.

* * * * *